US007226311B2

(12) United States Patent
Sugita

(10) Patent No.: US 7,226,311 B2
(45) Date of Patent: Jun. 5, 2007

(54) SOCKET ASSEMBLY FOR CARD

(75) Inventor: Nobuhiro Sugita, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/411,773

(22) Filed: Apr. 27, 2006

(65) Prior Publication Data

US 2006/0252286 A1 Nov. 9, 2006

(30) Foreign Application Priority Data

May 6, 2005 (JP) ..... 2005-135241

(51) Int. Cl.
*H01R 13/60* (2006.01)

(52) U.S. Cl. ..... 439/541.5; 439/630

(58) Field of Classification Search ..... 439/79, 439/108, 541.5, 607, 630
See application file for complete search history.

(56) References Cited

U.S. PATENT DOCUMENTS 5,643,008 A * 7/1997 Tan et al. ..... 439/541.5
5,688,130 A * 11/1997 Huang ..... 439/79
6,068,509 A * 5/2000 Lin ..... 439/541.5
6,179,651 B1 * 1/2001 Huang ..... 439/541.5
6,179,652 B1 * 1/2001 Tung et al. ..... 439/541.5
7,059,872 B2 * 6/2006 Tanaka et al. ..... 439/79
7,108,545 B2 * 9/2006 Ting ..... 439/541.5

* cited by examiner

*Primary Examiner*—Thanh-Tam Le
(74) *Attorney, Agent, or Firm*—Takeuchi & Kubotera, LLP

(57) ABSTRACT

A socket assembly comprises a plurality of sockets (1 and 2) piled up in multiple tiers in the order of length of the sockets (1 and 2). Each of the sockets (1 and 2) has an opening (11 and 21), an accommodation space to receive a card (C1 or C2), and a closing member (12). A plurality of terminals are provided in the closing member (12) and have connection portions (4 and 5) on rear sides thereof extending rearwardly into the outside of the accommodation space and bent downwardly at right angles. At least part of the connection portion (4) of the lower-tier socket (1) is accommodated in a stepped space (3) defined by the rear end face of the lower-tier socket (1) and the rear lower face of the upper-tier socket (2).

9 Claims, 7 Drawing Sheets

Fig.1 (B) Prior Art

SOCKET ASSEMBLY FOR CARD

BACKGROUND OF THE INVENTION

The present invention relates to a socket assembly for cards, especially an assembly having multi-tiered sockets installed on a circuit board in parallel to the surface of the circuit board.

Recently, a PC card in conformity of PCMCIA standard has become widespread. The PC card is detachably installed on an electronic device, such as a personal computer, to enlarge the function of the electronic device. On the other hand, an express card is being developed to meet the recent requirements for high-speed information processing and small-sized devices. The express card is smaller than the PC card, corresponding to high-speed signals.

Considering the above-mentioned situation, where the already diffused card (PC card) and the newly diffused card (express card) are intermixed, it is preferable that a socket for the PC card and a socket for the small express card are integrally piled in a socket assembly.

The socket assembly is installed on the circuit board in the electronic device such that the cards inserted into the socket assembly are connected with the circuit board. At the present, two-tiered socket assembly is on the market. The two-tied socket assembly has a socket for the PC card in a lowest tier facing to the circuit board and a socket for the express card in an upper tier provided on the lowest tier.

Since the front openings of the two sockets are arranged at the same position, the rear end of the long socket for the PC card extends longer than that of the short socket for the express card. Each of the sockets has a terminal, which is brought into contact with the card. The terminal extends rearwardly and is bent at right angles to form a connection portion connected to the circuit board.

However, in such a conventional two-tiered socket assembly, mechanical and electrical improvements have been demanded.

That is, as mentioned above, the socket for the PC card provided in the lowest tier (hereinafter "lowest socket"), which directly faces to the circuit board, is long in the insertion direction of the card (hereinafter "card insertion direction") and the socket for the express card provided in the upper tier (hereinafter "upper socket") is short in the card insertion direction. Also, the openings of the respective sockets are arranged at the same position in respect to the panel of the electronic device for the convenience of the insertion of the cards. Consequently, the terminal of the upper socket extends around outside of the terminal of the lowest socket.

A mechanical problem about the conventional socket assembly is that the terminal of the upper socket becomes long, which results in a large dimension of the socket assembly in the card insertion direction. An electrical problem about the conventional socket assembly is that the long terminal makes worse the high-speed transmission characteristics required especially by the express card. If the dimension of the socket assembly in the card insertion direction is made small, the vertical portions of the two sockets, which are bent at right angles, become so close to increase the electromagnetic influences between the respective cards.

SUMMARY OF THE INVENTION

Therefore, an object of the present invention is to provide a socket assembly for cards, having a smaller size and better electrical characteristics.

In order to achieve the object, according to an aspect of the present invention, there is provided a socket assembly which comprises a plurality of tiers of sockets integrally piled one upon another for accommodating a plurality of cards having different lengths in a card insertion direction. Each of the sockets comprises an opening provided on the front side of the socket, an accommodation space provided in the socket to permit one of the cards to enter from the opening, and a plurality of terminals arranged on a rear side of the socket. The terminals are brought into contact with the card accommodated in the accommodation space and have connection portions on rear sides thereof extending rearwardly into the outside of the accommodation space and bent downwardly at right angles in respect to the card insertion direction.

In such a socket assembly, the sockets are piled from the lowest tier to upper tiers in the order of length, from small to large, of the sockets in the card insertion direction provided that all openings of the sockets are arranged at the same position in the card insertion direction. At least part of the connection portions of the terminals of a socket provided in the lowest tier (herein after "lowest socket") is accommodated in a stepped region defined by the rear lower face of sockets provided in the upper tiers (hereinafter "upper sockets") and the rear end face of the lowest socket.

Since at least part of the connection portions of the terminals of the lowest socket is accommodated in the stepped region, the terminals of the upper sockets extending rearwardly become short. Consequently, the socket assembly becomes small in the card insertion direction and the transmission paths of the connection portions of the terminals become also short.

The socket assembly further may comprise a connector, at least part of which is accommodated in the stepped region. The connector includes a housing having a plurality of support portions for supporting the connection portions of the terminals. With this structure, the connection portions are firmly supported by the support portions of the connector.

The housing has a plurality of wall portions extending downwardly, in which the support portions are provided. Separation spaces or air layers are provided between the respective wall portions to reduce the interference in the high-speed transmission.

It is preferable that a distance between vertical portions of the connection portions of the terminals of the upper and lowest sockets is equal to a distance between rear ends of the upper and lowest sockets. Since large distance between the connection portions is desirable in electrical viewpoint, the distance between the rear edges of the upper and lowest sockets can be utilized to the maximum extent.

When the sockets are provided in two tiers and the connection portions of the two sockets are supported by the support portions provided on external surfaces of the wall portions, the distance between the connection portions can be made large.

By providing shield plates between the respective support portions of the connector, it is possible to produce the shield effect between the connection portions of the terminals.

By linking wall portions of the connector to each other with side wall portions provided at side ends of the wall portions in a terminal arrangement direction, it is possible to reinforce the wall portions.

Providing the connector with engagement posts extending downwardly to be plugged into engagement dents provided in a connector attached to a circuit board facilitates the positioning between the socket assembly and the circuit board upon plugging operation.

As described above, since the sockets are piled one upon another on the circuit board in the order of length, from small to large, of the sockets in the card insertion direction, the connection portions of the terminals can be arranged in the stepped region provided by the rear portions of the sockets due to the difference in length of the sockets. Consequently, the socket assembly can be made small in the card insertion direction and the length of the connection portion of the terminal of the upper socket can be minimized, which results in the improvement of electrical characteristics in the high-speed transmission.

BRIEF DESCRIPTION OF THE DRAWAINGS

Figure 5:
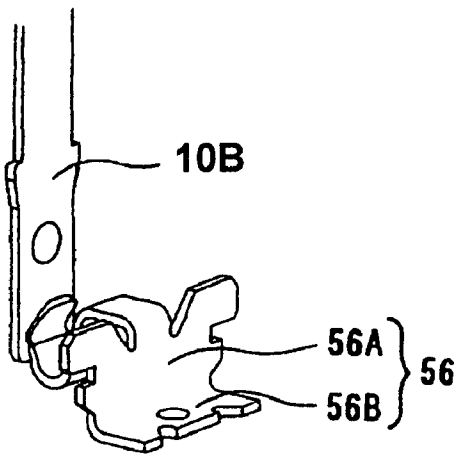
Figure 5:
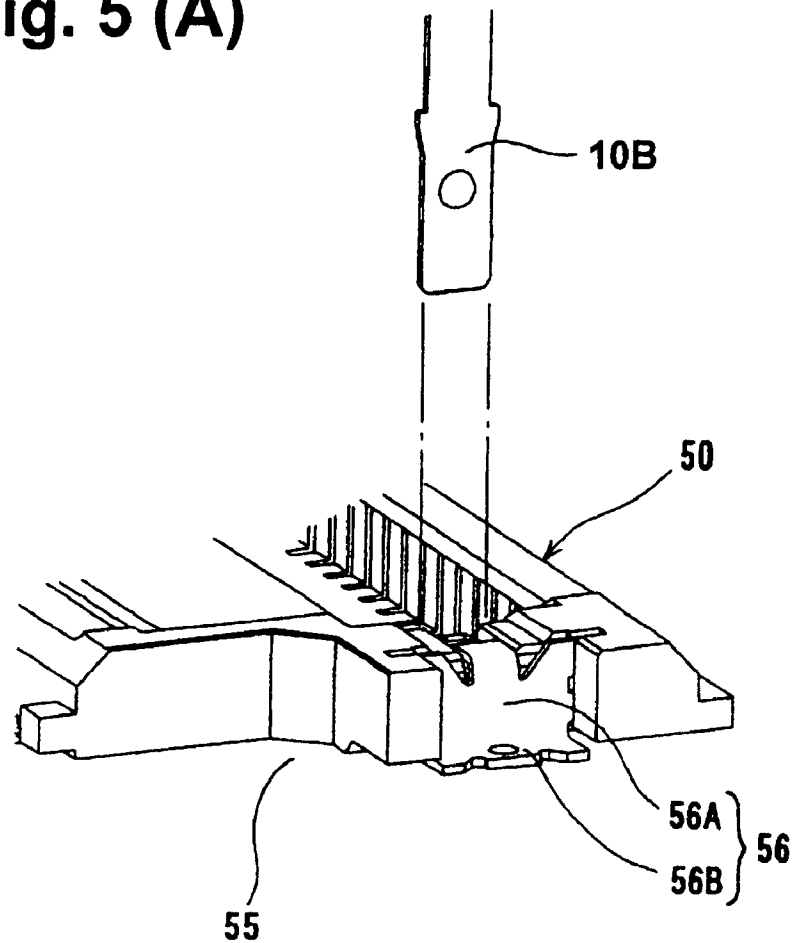
Figure 6:
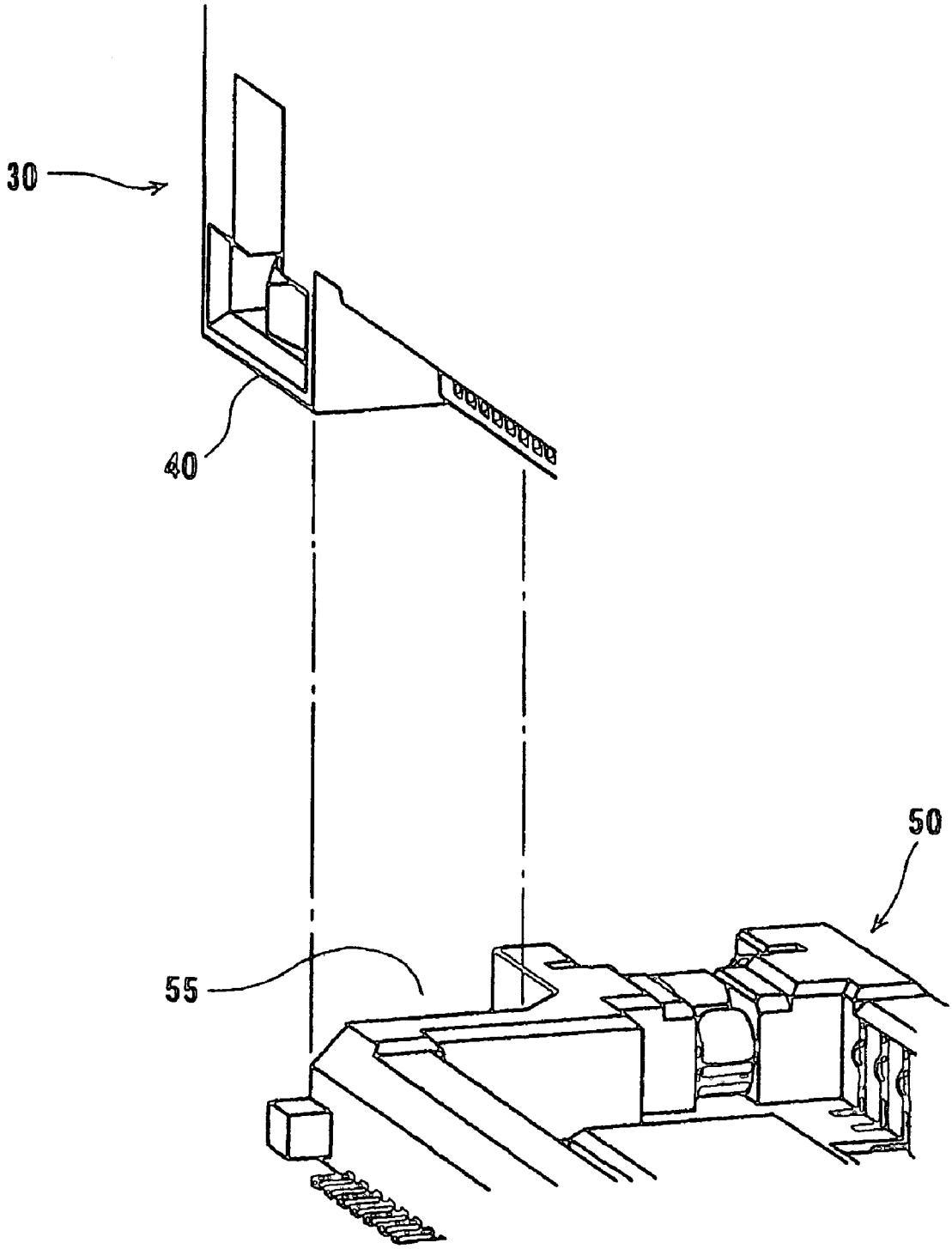

FIGS. 5(A) and (B) are perspective views of a connection piece of an upper socket and a ground terminal of a circuit board connector, wherein FIG. 5(A) shows a condition before connection and FIG. 5(B) shows a condition after connection;

FIG. 6 is a perspective view of an engagement post of a connector for connecting the upper socket to the lower socket and a dent portion of the circuit board connector; and FIGS. 7(A) and 7(B) show the third embodiment of the present invention, wherein FIG. 7(A) is a perspective view of a shield plate, and FIG. 7(B) is a sectional view of the shield plate installed on the connector of FIG. 6 for contact with a ground terminal of the lower socket.

DETAILED DESCRIPTION OF THE PRESENT INVENTION

The embodiments of the present invention will now be described in reference to the attached drawings.

First Embodiment

Figure 1:
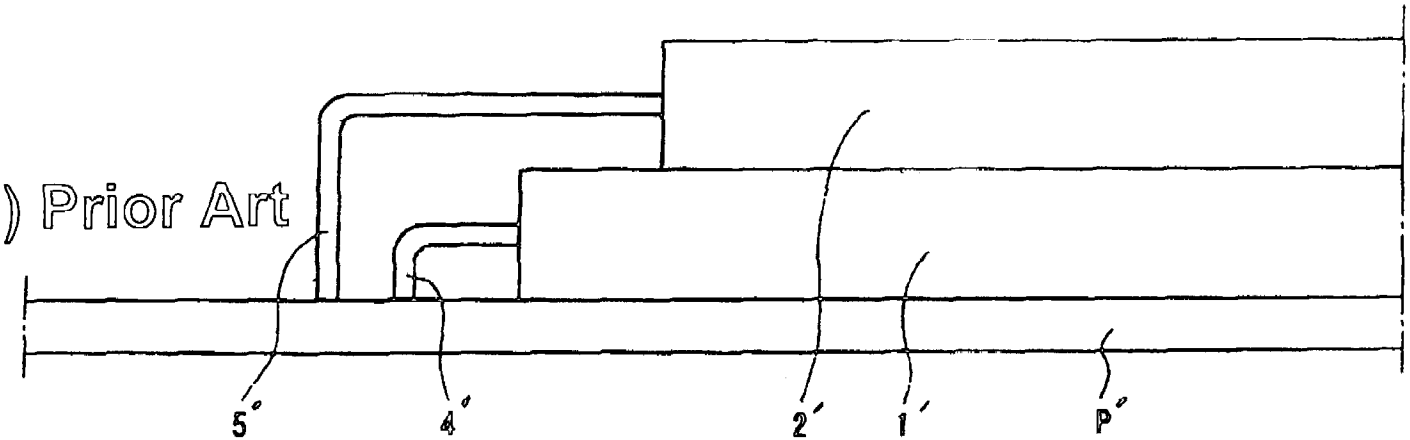
FIG. 1(A) is a side view of a rear portion of a socket assembly according to the first embodiment of the present invention.
FIG. 1(B) is a side view of a rear portion of a conventional socket assembly.
Figure 1:
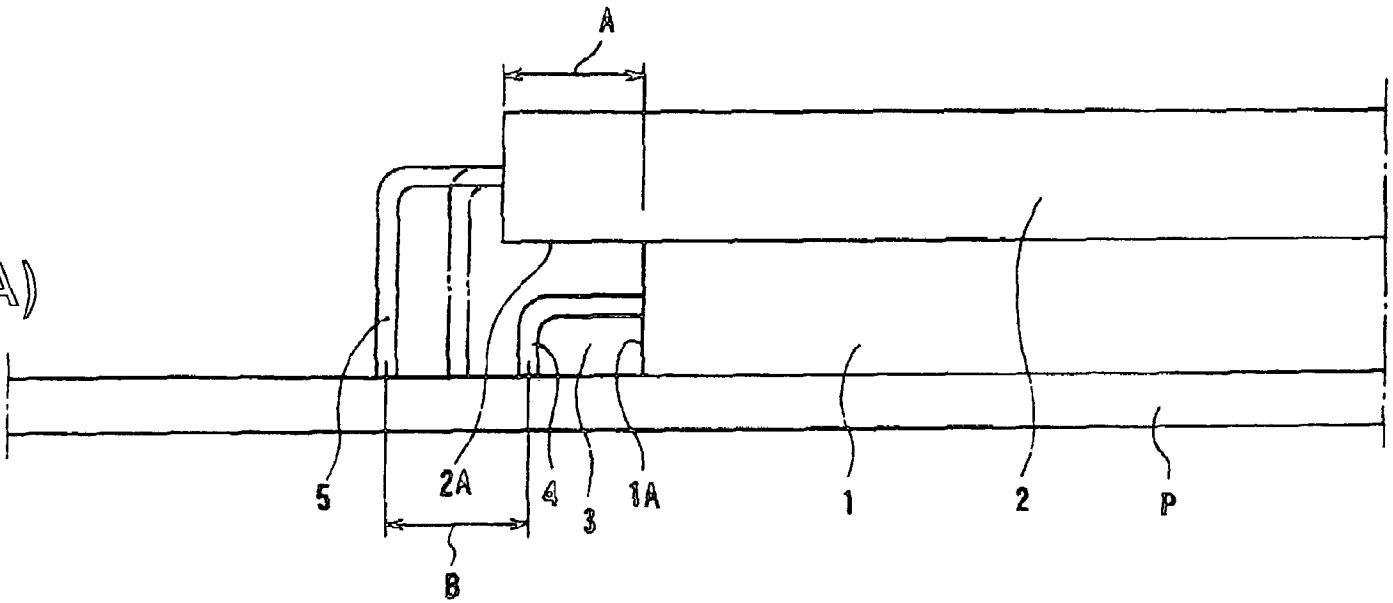

FIG. 1(A) shows a socket assembly according to the present invention and FIG. 1(B) shows a conventional socket assembly. Each assembly has two sockets having different lengths in the card insertion direction (lateral direction in the drawings). The two sockets are piled in two tiers on a circuit board. The respective sockets have openings, into which cards are inserted, on the right-hand side in the drawings. However, the openings are not shown and only the rear ends of the sockets on the left-hand side are shown in the drawings.

In FIG. 1(A), the socket assembly according to the present invention, a socket 1 in the lowest tier (hereinafter "lowest socket 1") provided directly on a circuit board P is short and a socket 2 in the upper tier (hereinafter "upper socket 2") provided on the lowest socket 1 is longer. The openings of the lower and upper sockets 1 and 2 on the right-hand side are arranged at the same position in the card insertion direction. Accordingly, there is a difference A in length between the positions of the rear ends of the lower and upper sockets 1 and 2 on the left-hand side in the card insertion direction. The sockets 1 and 2 are made integral by metal fittings not shown. The shorter socket 1 in the lowest tier is used for, for example, an express card, and the longer socket 2 in the upper tier is used for PC card.

A stepped region 3 is defined by the left end face 1A of the lowest socket 1 and the left-side lower face 2A of the upper socket 2. A connection portion 4 of a terminal of the lowest socket 1 is accommodated in the stepped region 3. The connection portion 4 extends outwardly from the left end face 1A of the lowest socket 1 and is bent downwardly. Similarly, a connection portion 5 of a terminal of the upper socket 2 extends from the left end face 2A of the upper socket 2. Both the connection portions 4 and 5 of the sockets 1 and 2 are connected to designated circuitries of the circuit board P. A distance B between vertical portions of the connection portions 4 and 5 is substantially equal to the difference A between the lengths of the sockets 1 and 2. In electrical viewpoint, the larger distance B is more desirable but, in mechanical viewpoint, the smaller distance B is more desirable. That is, the distance B should be small in order to make a small socket assembly. Considering both the conditions, the distance B is made equal to the difference A and kept as large as possible to the extent that it does not interfere with making a small socket assembly.

In the conventional socket assembly in FIG. 1(B), on the contrary to the socket assembly according to the present invention, a lowest socket 1' is long and an upper socket 2' is shorter. When comparing both the socket assemblies, the socket assembly according to the present invention is made smaller in the card insertion direction because it utilizes the stepped region 3 more efficiently. Also, the connection portion 5 of the upper socket 2 according to the present invention (FIG. 1(A)) is shorter than that of the conventional socket assembly (FIG. 1(B)). The distance between the vertical portions of the connection portions 4' and 5' in the conventional socket assembly (FIG. 1(B)) is smaller than that of the present invention (FIG. 1(A)). Accordingly, if the distance B in the present invention is made as small as that of the conventional socket assembly, the socket assembly becomes smaller in the card insertion direction as shown by a two-dot chain line in FIG. 1(A). In other words, even if the distance B shown by a solid line in FIG. 1(A) is made larger, the socket assembly according to the present invention can be made smaller than the conventional socket assembly in the card insertion direction.

Second Embodiment

The second embodiment has a more complex structure than the first embodiment of the present invention. In the first embodiment, the connection portions of the terminals of the sockets are directly connected to the circuit board. In the second embodiment, the connection portions are connected to the circuit board through a first connector fixed to the sockets and a second connector fixed to the circuit board.

Figure 2:
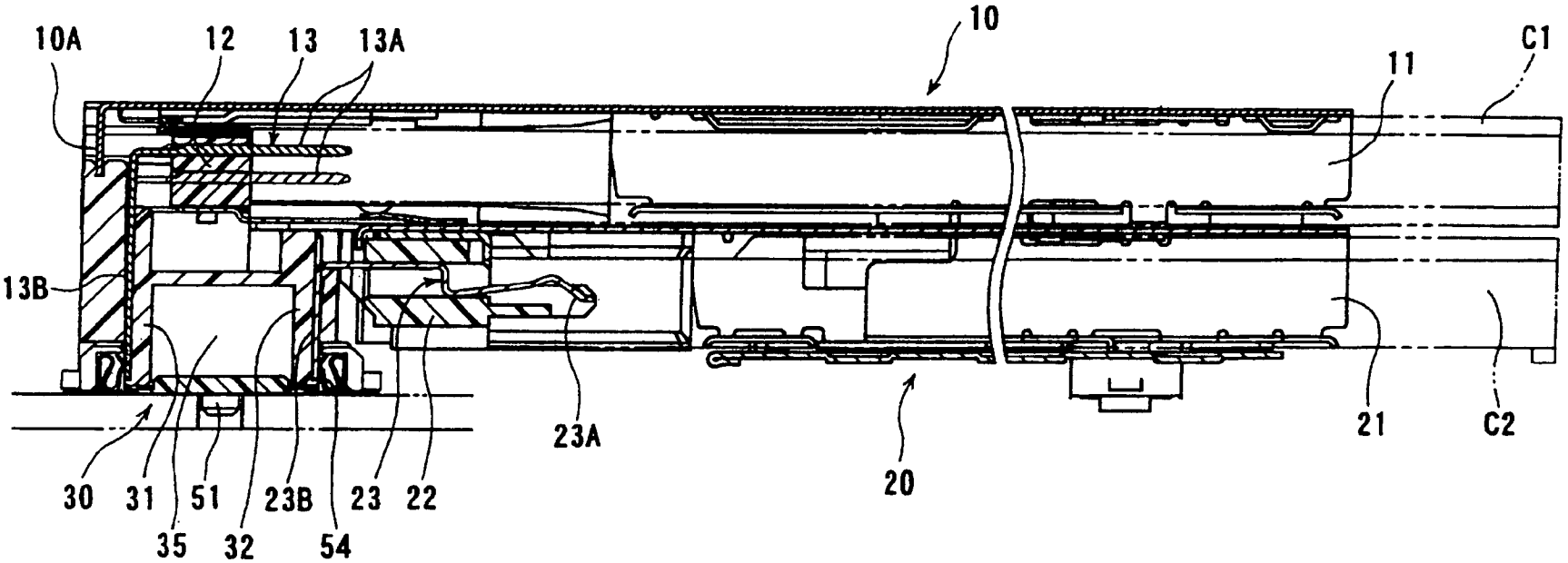
FIG. 2 is a sectional view of a socket assembly according to the second embodiment of the present invention.
Figure 3:
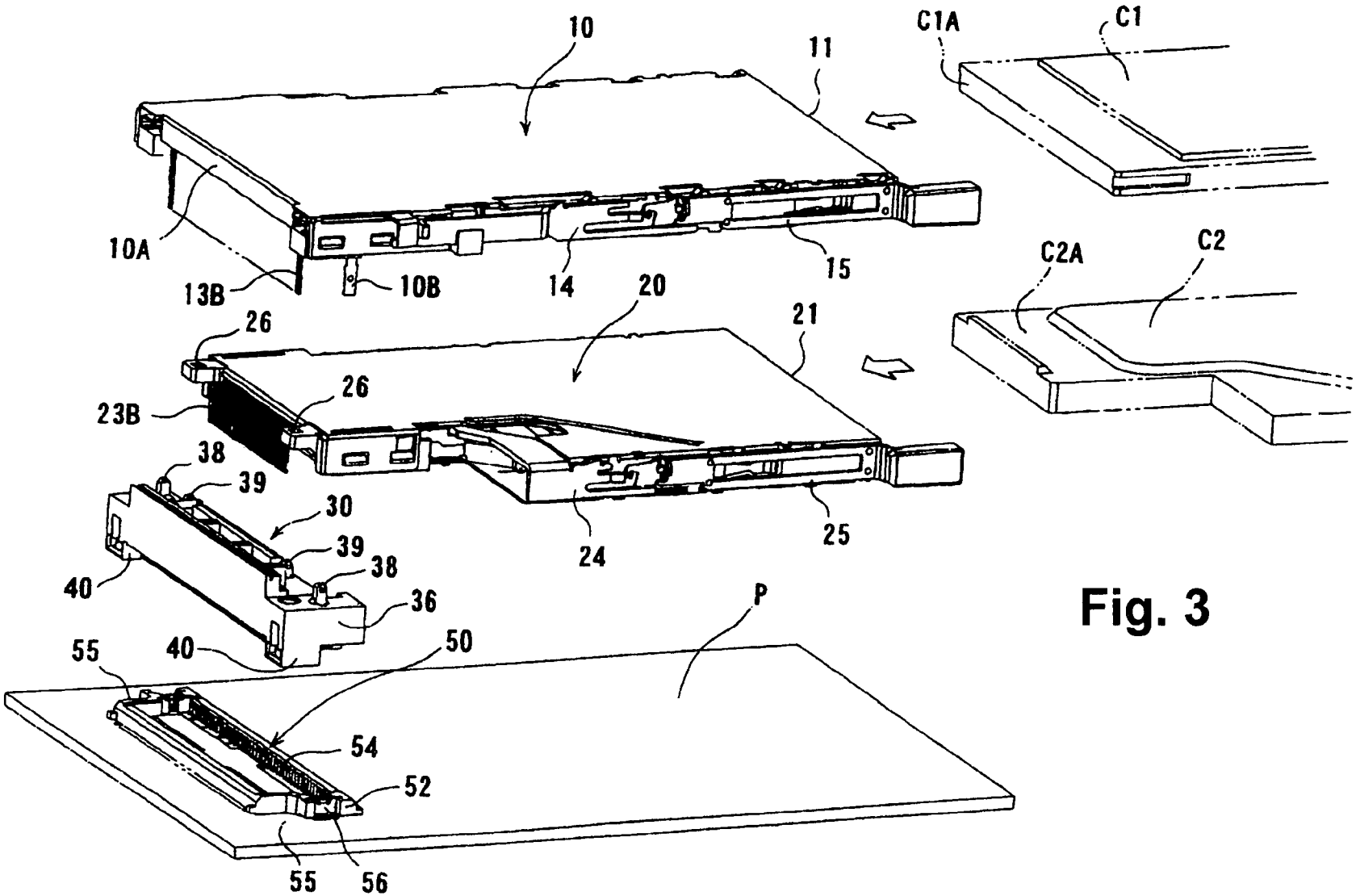
FIG. 3 is an exploded perspective view of the socket assembly of FIG. 2.
Figure 4:
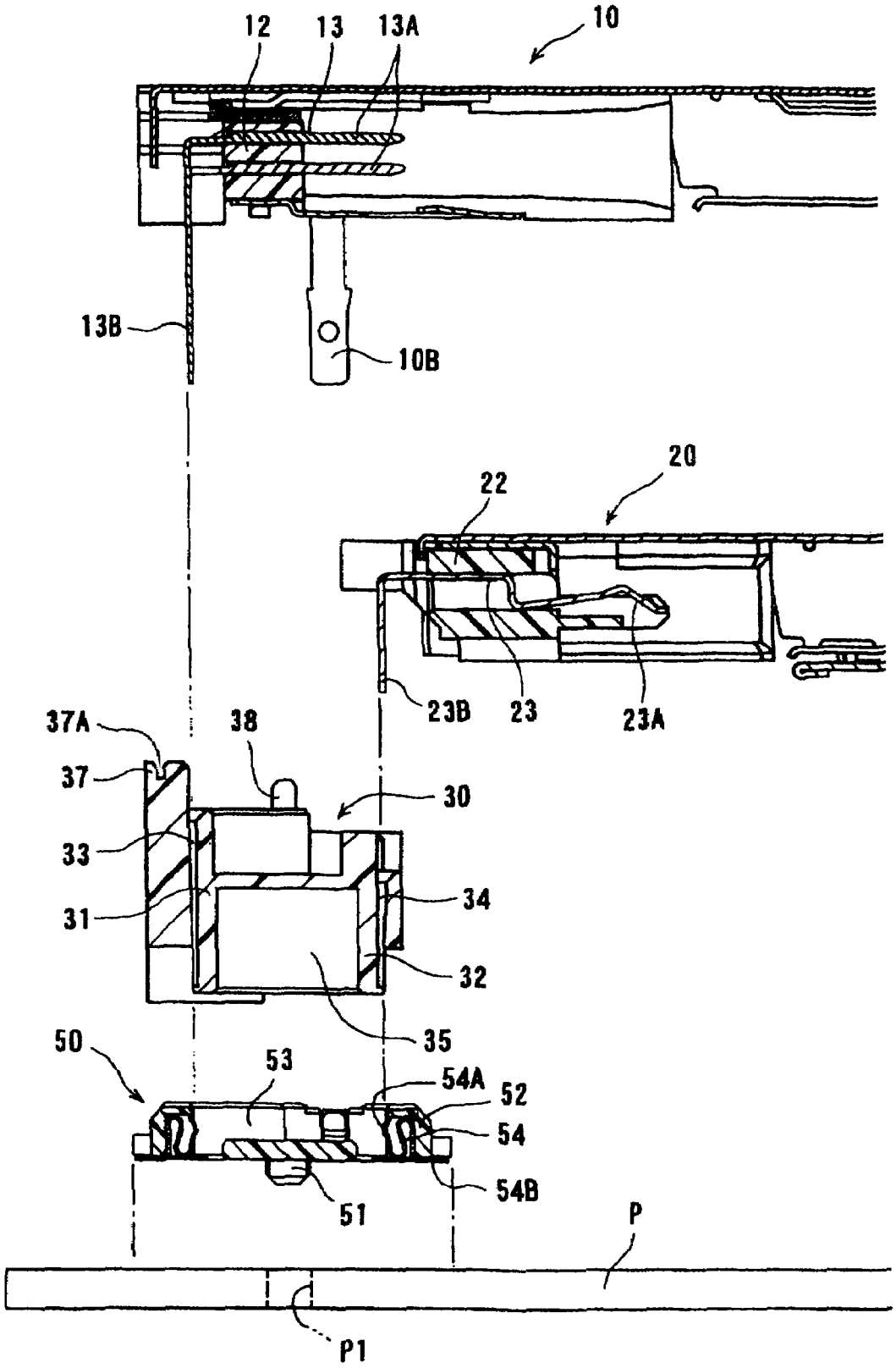
FIG. 4 is enlarged sectional views of rear portions of each component of the socket assembly.

FIG. 2 is a sectional view of a socket assembly according to the second embodiment, FIG. 3 is a perspective view of main parts, such as sockets and connectors, of the socket assembly of FIG. 2, showing the status after the main parts are separated, and FIG. 4 is a sectional view of the rear side of the main parts of FIG. 3.

In FIG. 3, the socket assembly comprises a socket 10 provided in an upper tier (hereinafter "upper socket 10"), a socket 20 provided in a lower tier (hereinafter "lower socket 20"), and a socket connector 30. The socket connector 30 is plugged into a board connector 50 fixed to a circuit board P.

In FIG. 2, the upper socket 10 has a shape of rectangular tube and is made by stamping and bending a metal sheet. The upper socket 10 is provided with an opening 11 on the front side (right-hand side in the drawing) and a closing member 12 of a dielectric material on the rear side thereof. The upper socket 10 has an accommodation space into which a PC card C1 having a rectangular shape is inserted through the opening 11. A plurality of terminals 13 are arranged through and supported by the closing member 12. The respective terminals 13 have a contact portion 13A on the front side thereof and a connection portion 13B on the rear side thereof. The contact portion 13A extends forwardly from the closing member 12 into the inside of the socket (accommodation space) and the connection portion 13B extends rearwardly from the closing member 12 and are bent downwardly. The contact portion 13A enters a connection hole (not shown) provided in the front end face C1A of the PC card C1 inserted into the accommodation space of the upper socket 10.

The upper socket 10 is provided with, on the side face thereof, a mechanism 14 for ejecting the PC card C1 and a pushing rod 15 for driving the ejecting mechanism 14. However, the ejecting mechanism 14 and the pushing rod 15 are not subjects of this invention and further description thereon will be omitted.

The upper socket 10 functions as not only a case for accommodating the PC card C1 but also a shield member because it is made of a metal sheet. A cover portion 10A for covering the closing member 12 is provided on the rear end face of the socket 10 and connection pieces 10B are provided on the side faces in the vicinity of the rear end of the socket 10.

As shown in FIGS. 2 and 4, a plurality of terminals 13 is arranged in a direction perpendicular to the sheet (hereinafter "arrangement direction"). In an example shown in the drawings, every two contact portions 13A of the terminals 13 are alternately placed at upper and lower positions and the connection portions 13B are offset to each other in the arrangement direction. Thus, the contact portions 13A are arranged in two tiers and the connection portions 13B are arranged in a row. Accordingly, the interval in the arrangement direction between the contact portions 13A is twice as large as the interval between the connection portions 13B.

The lower socket 20 provided under the upper socket 10 has also a shape of rectangular tube and made by stamping and bending a metal sheet. The lower socket 20 is provided with an opening 21 at the front end thereof and a closing member 22 of a dielectric material at the rear end thereof. The lowest socket 20 has an accommodation space therein, into which an express card C2 is inserted through the opening 21. The express card C2 is shorter than the PC card C1 in the card insertion direction. The width of the express card C2 is small on the front side thereof and becomes larger step by step from the middle toward the rear end thereof. The largest width of the express card C2 in the rear end portion is equal to the width of the PC card C1. The accommodation space inside the socket 20 is formed so as to correspond to the shape of the express card C2, that is, the accommodation space in the socket 20 is shorter than that of the socket 10 in the card insertion direction and has a stepped shape to fit the express card C2. A plurality of terminals 23 are arranged through the closing member 22. The respective terminals 23 have a contact portion 23A on the front side thereof and a connection portion 23B on the rear side thereof. The contact portion 23A extends forwardly from the closing member 22 into the inside of the socket 20 (accommodation space) and the connection portion 23B extends rearwardly from the closing member 22 and then downwardly. A bent portion (vertical portion) provided at the front end of the contact portion 23A is brought into wiping contact with a connection portion (not shown) provided on the front end face C2A of the express card C2 inserted in the accommodation space of the lowest socket 20.

The upper socket 20 is provided with, on the side face in the large-width part thereof, a mechanism 24 for ejecting the express card C2 and a pushing rod 25 for driving the ejecting mechanism 24. However, the ejecting mechanism 24 and the pushing rod 25 are not subjects of this invention and further description thereon will be omitted.

The upper socket 20 functions as not only a case for accommodating the express card C2 but also a shield member because it is made of a metal sheet.

The connector 30 for supporting the terminals 13 of the upper socket 10 and the terminals 23 of the lowest socket 20 is made of a dielectric material. As shown in FIG. 2, when the openings 11 and 21 of the sockets 10 and 20 are arranged at the same position in the card insertion direction, most of the connector 30 is accommodated in a stepped region defined by the rear end lower face of the upper socket 10 and the rear end face of the lowest socket 20.

As shown in FIG. 4, the connector 30 has a substantially "H" shaped sectional shape having a rear wall 31 and a front wall 32 extending vertically in parallel to each other. Slit shaped support portions 33 and 34 are provided in the rear and front wall portions 31 and 32, respectively. The connection portions 13B and 23B of the terminals 13 and 23 are press-fitted into and supported by the support portions 33 and 34. The slits of the support portions 33 and 34 are tapered downwardly from the upper opening thereof, that is, the width of the slits is largest at the upper opening and gradually becomes smaller toward the lower part thereof, so that the connection portions 13B and 23B are easily inserted into the slits and firmly supported by the slits with the progress of the insertion. The lower parts of the support portions 33 and 34 are opened to the rear and front sides thereof, respectively, so that the lower parts of the connection portions 13B and 23B are exposed in the rear and front sides thereof when the connection portions 13B and 23B are inserted into the support portions 33 and 34. The exposed parts of the connection portions 13B and 23B are brought into contact with terminals of the below-mentioned circuit board connector when the connector 30 is plugged into a receiving space of the circuit board connector.

The distance between the support portions 33 and 34 is equal to the difference between the lengths, in the card insertion direction, of the sockets 10 and 20. The rear and front wall portions 31 and 32 provide an air layer 35 therebetween and are linked to each other by side walls 36 (FIG. 3) provided at ends thereof in a direction perpendicular to the sheet of FIG. 4. The rear, front, and side walls 31, 32, and 36 define a box shaped space opened at the bottom. The rear wall 31 has a projecting wall portion 37 projecting upwardly on the left-hand side of the support portion 33. A groove portion 37A is provided in the upper face of the projecting wall portion 37 to receive the lower edge of the cover portion 10A of the socket 10. A lower part of the side wall 36 may be cut off to provide a path for a ground terminal and so forth.

As shown in FIG. 3, support posts 38 and 39 are provided on the upper faces of the side walls 36 to be plugged into holes (not shown) of the socket 10 and holes 26 of the socket 20 for connecting the connector 30 to the sockets 10 and 20.

In FIG. 6, an engagement post 40 having a shape of rectangular tube is provided on the lower face of the side wall 36. The engagement post portions 40 engage engagement dents 55 of the below-mentioned circuit board connector 50 to easily determine the plugging position between the connectors 30 and 50 and to function as a fixing portion where the connector 30 is attached to the circuit board with a nut.

The circuit board connector 50 comprises a housing 52, a leg portion 51 to be plugged into a receiving hole P1 of the circuit board P (FIGS. 2 and 4), and a receiving dent 53 with upward opening provided in the housing 52. A plurality of substantially "S" shaped resilient terminals 54 are provided in grooves formed in opposite side walls of the receiving dent 53. A contact portion 54A provided on one side of the terminal 54 slightly projects into the inside of the receiving dent 53 and another contact portion 54B provided on the other side of the terminal 54 is bent on the bottom of the housing 52 to be exposed. Both sides of the housing 52 are cut off to provide a pair of engagement dents 55 to receive the engagement posts 40 of the connector 30.

A pair of ground terminals 56 is provided in the side walls of the housing 52. The ground terminal 56 has an "L" shape and has a contact section 56A extending along a wall of the housing 52 and a leg-shaped fixing section 56B extending laterally. The fixing section 56B is fixed to a designated ground circuitry (not shown) on the circuit board P. The contact section 56A is brought into contact with the connection piece 10B of the socket 10 when the connection piece 10B moves from the position in FIG. 5(A) to the position in FIG. 5(B). If the socket 20 is connected to the socket 10 by a metal piece, the socket 20 is grounded through the connection piece 10B and the ground terminal 56.

Thus, the sockets 10 and 20 according to the second embodiment are assembled with the connector 30 and connected to each other by a metal piece (not shown). The connection between the sockets 10 and 20 may be made before or after they are incorporated into the connection 30.

Since the lengths of the sockets 10 and 20 are different in the card insertion direction, most of the connector 30 is accommodated in the stepped region defined by the sockets 10 and 20. It means that the dimension of the card assembly in the card insertion direction can be minimized and that the transmission paths of the terminals of the sockets 10 and 20 can be also minimized. When the connector 30 of the connector assembly is plugged into the circuit board connector 50 and when the cards are inserted into the sockets 10 and 20 of the socket assembly, the cards are electrically connected to the circuit board P. Also, a space is produced behind the stepped region because of the difference in width between the sockets 10 and 20, other electronic parts may be mounted on the circuit board to utilize such a space in the socket assembly.

Third Embodiment

Figure 7:
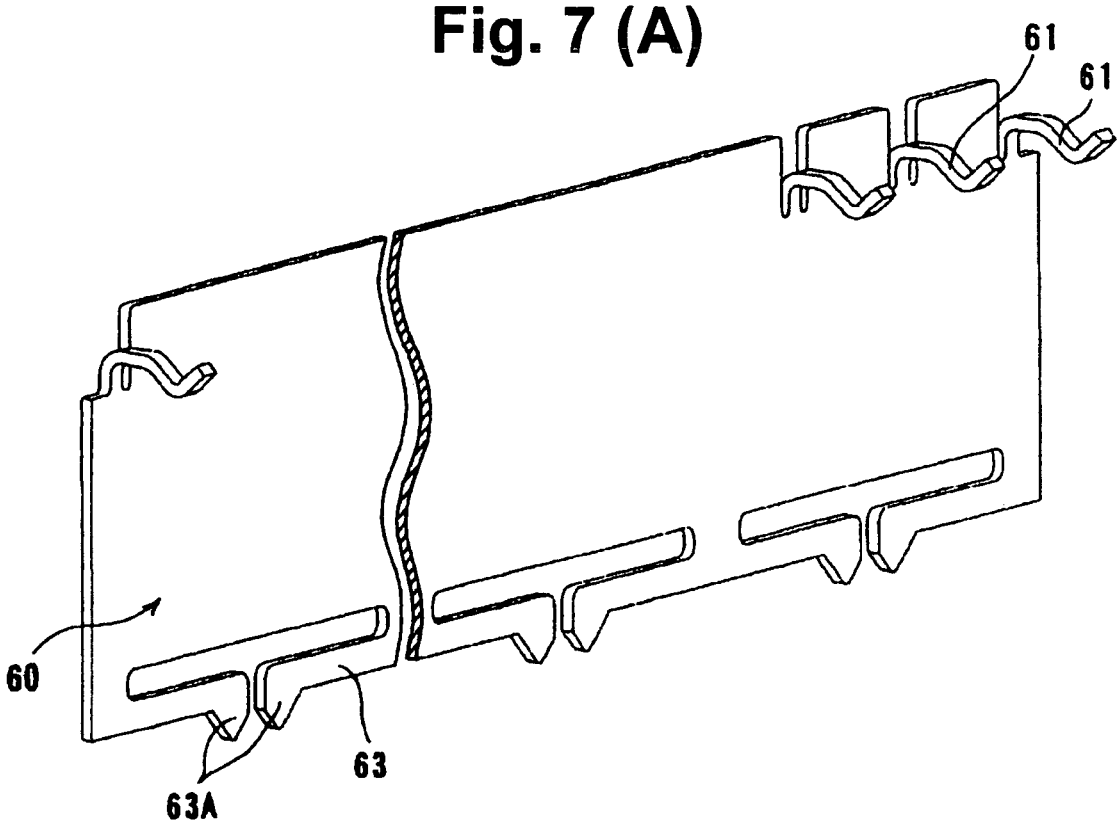
Figure 7:
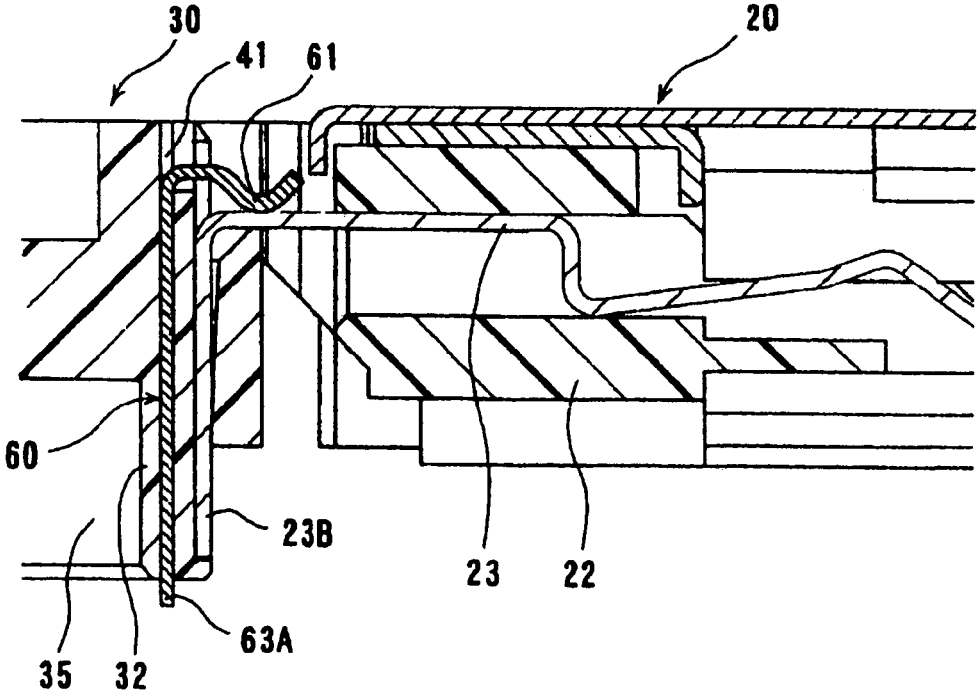

In the third embodiment shown in FIG. 7, a shield plate 60 is provided in the connector 30 between the connection portions 13B and 23B of the terminals 13 and 23 of the sockets 10 and 20.

In FIG. 7(B), a groove 41, which is adapted to receive the shield plate 60 shown in FIG. 7(A), extends vertically at the substantially center of the front wall 32 of the socket 30 in the thicknesswise direction of the front wall portion 32 and is opened forwardly on the upper side thereof.

In this embodiment, most of the terminals 23 of the socket 20 are used as signal terminals but some of the terminals 23 are used as ground terminals. The shield plate 60 has several resilient contact portions 61 at the upper edge thereof. The contact portions 61 are made by bending the shield plate 60 at positions corresponding to those of the ground terminals. In an example shown in FIG. 7(A), four contact portions 61 are provided corresponding to four ground terminals.

A plurality of elongated holes 62 are provided in the lower side of the shield plate 60. The elongated hole 62 is opened through the lower edge of the shield plate 60 at the center thereof in the longitudinal direction thereof to provide a pair of resilient arms 63. Contact portions 63A extend downwardly from the free ends of the respective resilient arms 63.

When the shield plate 60 is inserted into the groove 41 of the front wall 32 from the upside, as shown in FIG. 7(B), the resilient contact portion 61 of the shied plate 60 is brought into contact with the ground terminal 23 of the socket 20 and the contact portion 63A projects downwardly from the housing of the connector 30 to be brought into contact with ground circuitry (not shown) of the circuit board.

As described above, the terminals 13 and 23 of the sockets 10 and 20 are shielded from each other by the shield plate 60 and the ground terminals of the socket 20 are grounded to the circuit board.

The shield plate 60 may be arranged in the air layer 35. However, in this embodiment, since the shield plate 60 is arranged in the front wall portion 32, the air layer 35 is left large as it is.

The invention is not limited to the two-tierd socket assembly but can be applied to a socket assembly having more tiers of sockets. In the case, a socket having the smallest length in the card insertion direction is arranged at the lowest tier and sockets having larger lengths are arranged in upper tiers in the order of length.

The invention claimed is:

1. A socket assembly including a plurality of sockets piled up in a plurality of tiers for accommodating a plurality of cards having different lengths in a card insertion direction, each of said sockets comprising:

an opening provided on a front end of said each socket, wherein all openings of said sockets are arranged at the same position in said card insertion direction;

an accommodation space extending rearwardly from said opening to receive one of said cards through said opening;

a plurality of terminals arranged on a rear side of said each socket, said terminals being brought into contact with said one of said cards in said accommodation space and having connection portions projecting rearwardly from said each socket and bent downwardly at right angles with respect to said card insertion direction, said sockets being piled up from bottom tier to top tier in an order of increasing length in said card insertion direction to form a stepped space that is defined by a rear end face of a lower-tier socket and a rear lower face of another socket provided in an upper tier; and a connector, at least part of which is accommodated in said stepped space, said connector including a housing having a plurality of support portions for supporting said connection portions of said terminals, wherein said housing has front and rear walls extending vertically, in each of which said support portions are provided, such that an air layer is provided between said front and rear walls when said connector is plugged in another connector attached to a circuit board; wherein said sockets are provided in two tiers and said connection portions of said terminals in said two tiers are supported by said support portions provided on external surfaces of said front and rear walls such that when said connector is plugged in said another connector, said connection portions are brought into contact with terminals of said another connector outside said air layer between said front and rear walls.

2. The socket assembly according to claim 1, wherein a distance between vertical portions of said connection portions of said terminals of said upper- and lower-tier sockets is equal to a distance between rear ends of said upper- and lower-tier sockets.

3. The socket assembly according to claim 1, wherein said connector further comprises a shield plate provided between respective said support portions of said connector.

4. The socket assembly according to claim 1, wherein said walls of said connector are linked to each other by side walls provided at opposite ends of said walls in a terminal arrangement direction.

5. The socket assembly according to claim 1, wherein said connector has at least one engagement post extending downwardly, which is fitted into an engagement dent provided in said another connector attached to said circuit board.

6. The socket assembly according to claim 5, wherein said another connector comprises a housing having a receiving dent and a plurality of other terminals having contact portions projecting into an inside of said receiving dent so that when said connector is plugged into said another connector, said connection portions on said external surfaces are brought into contact with said other terminals so that said air layer remains intact.

7. The socket assembly according to claim 1, wherein said terminals are arranged in a closing member made of a dielectric material provided at said rear side of said socket.

8. The socket assembly according to claim 1, wherein said terminals have contact portions on front sides thereof extending forwardly into said accommodation space for contact with said card accommodated in said accommodation space.

9. The socket assembly according to claim 1, wherein said support portions provided in said walls are grooves, into which said connection portions are fitted, said grooves being tapered so as to become narrower toward an end thereof.

* * * * *